US010068408B2

(12) United States Patent
Mason

(10) Patent No.: US 10,068,408 B2
(45) Date of Patent: Sep. 4, 2018

(54) VENDING MACHINE ADJUSTABLE DEPTH RETAINER

(71) Applicant: Paul Mason, Inwood, WV (US)

(72) Inventor: Paul Mason, Inwood, WV (US)

(73) Assignee: Automated Merchandising Systems Inc., Kearneysville, WV (US)

( * ) Notice: Subject to any disclaimer, the term of this patent is extended or adjusted under 35 U.S.C. 154(b) by 0 days.

(21) Appl. No.: 14/684,965

(22) Filed: Apr. 13, 2015

(65) Prior Publication Data

US 2016/0300423 A1 Oct. 13, 2016

(51) Int. Cl.

| | |
|---|---|
| ***G07F 9/10*** | (2006.01) |
| ***G07F 11/00*** | (2006.01) |
| ***G07F 11/62*** | (2006.01) |

(52) U.S. Cl.

CPC ..... *G07F 9/10* (2013.01); *G07F 11/007* (2013.01); *G07F 11/62* (2013.01)

(58) Field of Classification Search

CPC . G07F 9/10; G07F 11/02; G07F 11/04; G07F 11/08; G07F 11/10; G07F 11/46; G07F 11/60; G07F 11/62; G07F 11/007

See application file for complete search history.

(56) References Cited

U.S. PATENT DOCUMENTS 2,103,367 A * 12/1937 Hoban ..... G07F 11/10 194/255
2,249,234 A * 7/1941 Srodulski ..... G07F 9/10 211/149
2,272,682 A * 2/1942 Srodulski ..... G07F 9/10 221/242
2,836,326 A * 5/1958 Childers ..... G07F 11/007 192/15
2,890,813 A * 6/1959 Childers ..... G07F 11/007 221/199
3,145,066 A * 8/1964 O'Neal ..... A47F 1/08 221/242
3,158,246 A * 11/1964 Murphy ..... G07F 11/04 194/215
3,757,998 A * 9/1973 Millies ..... G07F 11/04 221/242
3,883,038 A * 5/1975 Bookout ..... G07F 11/24 221/112

(Continued)

FOREIGN PATENT DOCUMENTS

EP 1530172 A2 * 5/2005 ..... G07F 11/04

*Primary Examiner* — Andrew Mark Roersma
(74) *Attorney, Agent, or Firm* — Davidson Berquist Jackson & Gowdey LLP

(57) ABSTRACT

A vending machine is provided with an internal product holding assembly where product to be vended is held or stacked within each of a plurality of product holding compartments formed by a plurality of spaced apart stacking walls. Compartment depth is variable, so as to dispense varying length products, by a movable rear wall movably mounted to one side of a stacking wall so as to be incrementally adjustable within the compartment between a plurality of selected fore and aft positions. The stacking walls have a hollow interior housing an adjusting mechanism for incrementally moving the depth controlling rear wall, with the adjusting mechanism being operable from the front of the product holding assembly and retainable at a selected position.

11 Claims, 9 Drawing Sheets

(56) References Cited

U.S. PATENT DOCUMENTS

| | | | | | |
|---|---|---|---|---|---|
| 4,253,585 | A * | 3/1981 | Janisiewicz | B23P 19/004 | 221/242 |
| 5,392,953 | A * | 2/1995 | Maldanis | G07F 11/34 | 211/59.2 |
| 5,848,726 | A * | 12/1998 | Yajima | G07F 9/02 | 221/131 |
| 5,901,877 | A * | 5/1999 | Fujiu | G07F 11/04 | 221/150 HC |
| 6,116,462 | A * | 9/2000 | Takamura | G07F 11/007 | 221/241 |
| 7,100,795 | B2 * | 9/2006 | Kelly | G07F 11/007 | 221/131 |
| 7,416,111 | B1 * | 8/2008 | Kovacs | G07F 19/205 | 235/379 |
| 8,100,292 | B2 * | 1/2012 | Kelly | G07F 11/08 | 221/123 |
| 2016/0300422 | A1 * | 10/2016 | Mason | G07F 9/10 | |

* cited by examiner

VENDING MACHINE ADJUSTABLE DEPTH RETAINER

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO CO-PENDING APPLICATIONS

The present invention is related to the following co-pending U.S. Patent applications which are all commonly owned with the present application, the entire contents of each being hereby incorporated herein by reference thereto: (1) U.S. patent application Ser. No. 14/684,904, entitled "Double Thick Vending Machine Stack Wall," filed on Apr. 13, 2015.

FIELD OF THE DISCLOSURE

This disclosure relates to structures used in vending machines as stack walls to separate one set of products from another set of product inside the product holding area of a vending machine.

INTRODUCTION

This invention relates to vending machines, and in particular, to vending machines that can be stocked with vertical stacks of vendable products and with vertical stacks of products retained in columns in a product storage area therein.

Vertical stacks are one way to store and dispense products in vending machines and for many products is an efficient and effective way to store a maximum number of products. This is an important as the more items that can be stored in the machine the less often is the need to restock.

In a vending machine, internal column walls are employed to define a plurality of spaced apart, product storage magazines, zones or compartments. More specifically, a series of stacking walls are arranged at spaced positions within a vending cabinet and serve as partitions to contain, separate, and support a stack or vertically extending column of products to be dispensed, with that stack usually having a row of products that is two, three or four products in length. Not only are varying sized products frequently held in these magazines, but when new products are restocked in a particular compartment they may well have individual lengths that are different from the product previously held in that compartment. Consequently, there is a need for a back portion of each magazine, zone or compartment that can be moved forwardly or rearwardly to thereby vary the depth of each zone or compartment and thereby accommodate a new length for the product being restocked. Thus, when reloading a compartment with a new product having a different length it is now easy to move the rear retainer wall to a desired position to accommodate the new length for a row of a new product.

Prior art containment walls were primarily formed from sheet metal. To strengthen the sheet metal wall the outer edges might be bent or shaped to provide added perimeter strength and the central portions might be stiffened by various bracing components which could extend fore-to-aft or diagonally along the wall and are mechanically fastened to the respective column walls to ensure proper function.

A co-pending application Ser. No. 14/684,904 concerns a novel double wall stacking wall or retainer wall from which these magazines or zones within a product holding area of a vending machine can be constructed, and is hereby incorporated herein by reference thereto. This double wall construction now permits a novel and unique way of designing such a movable rear retainer wall for use with such vending machine product holding magazines, zones or compartments.

DESCRIPTION OF PRESENTLY PREFERRED EXAMPLES OF THE INVENTION

Brief Description of Figures

The invention is better understood by reading the following detailed description with reference to the accompanying drawings in which.

DESCRIPTION

A. Overview

Figure 1:
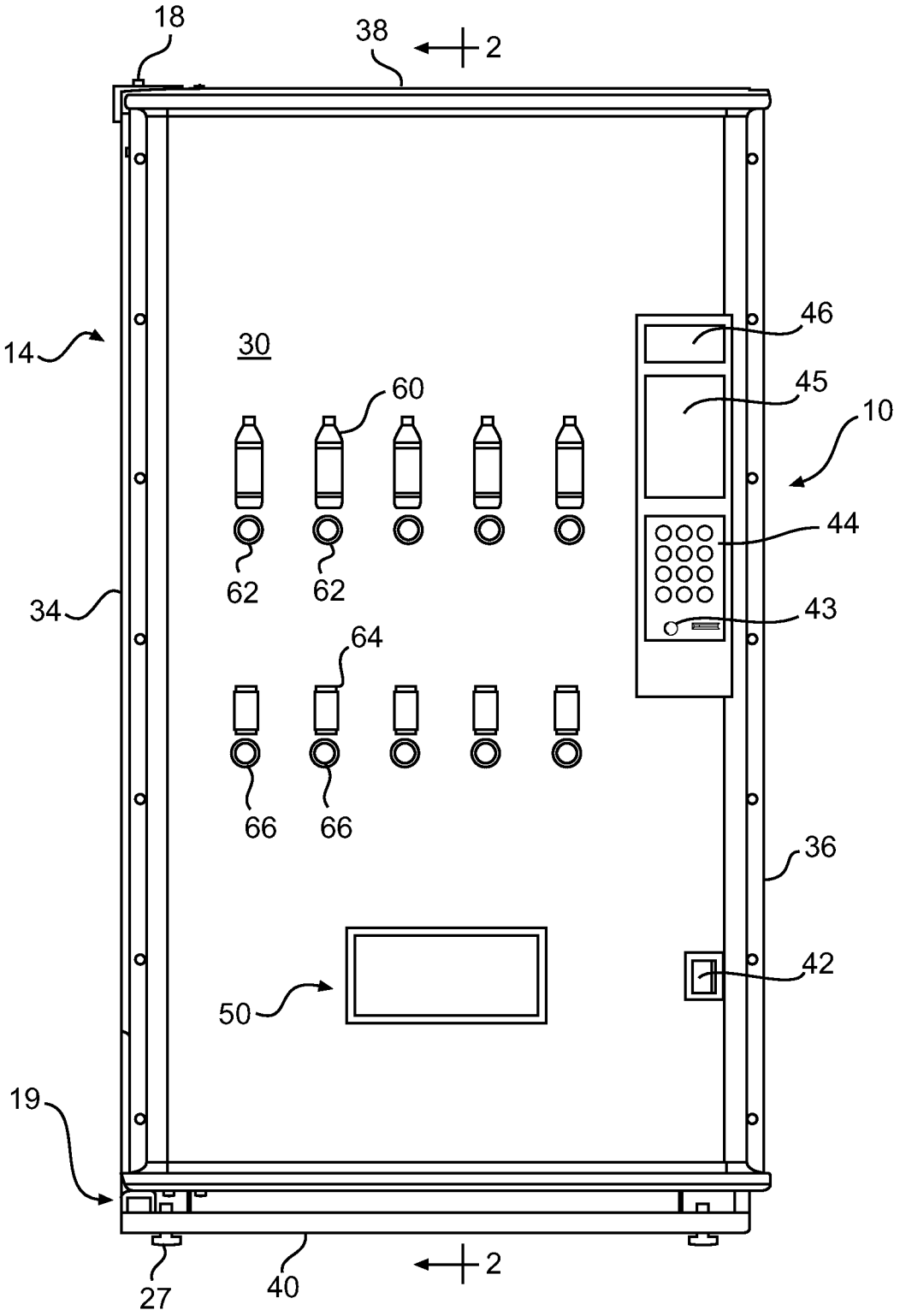
FIG. 1 is a frontal perspective showing the inside of a vending machine.

To gain a better understanding of the invention, a preferred embodiment will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The preferred embodiment now described will be with respect to a vending machine and to separate various sets or groupings of products from each other within the interior of a vending machine. The scale of the embodiment, therefore, is to be understood with respect to this type of article. It is to be understood as well, however, that the invention is applicable to other articles and its scale can vary accordingly.

C. Structure

Figure 2:
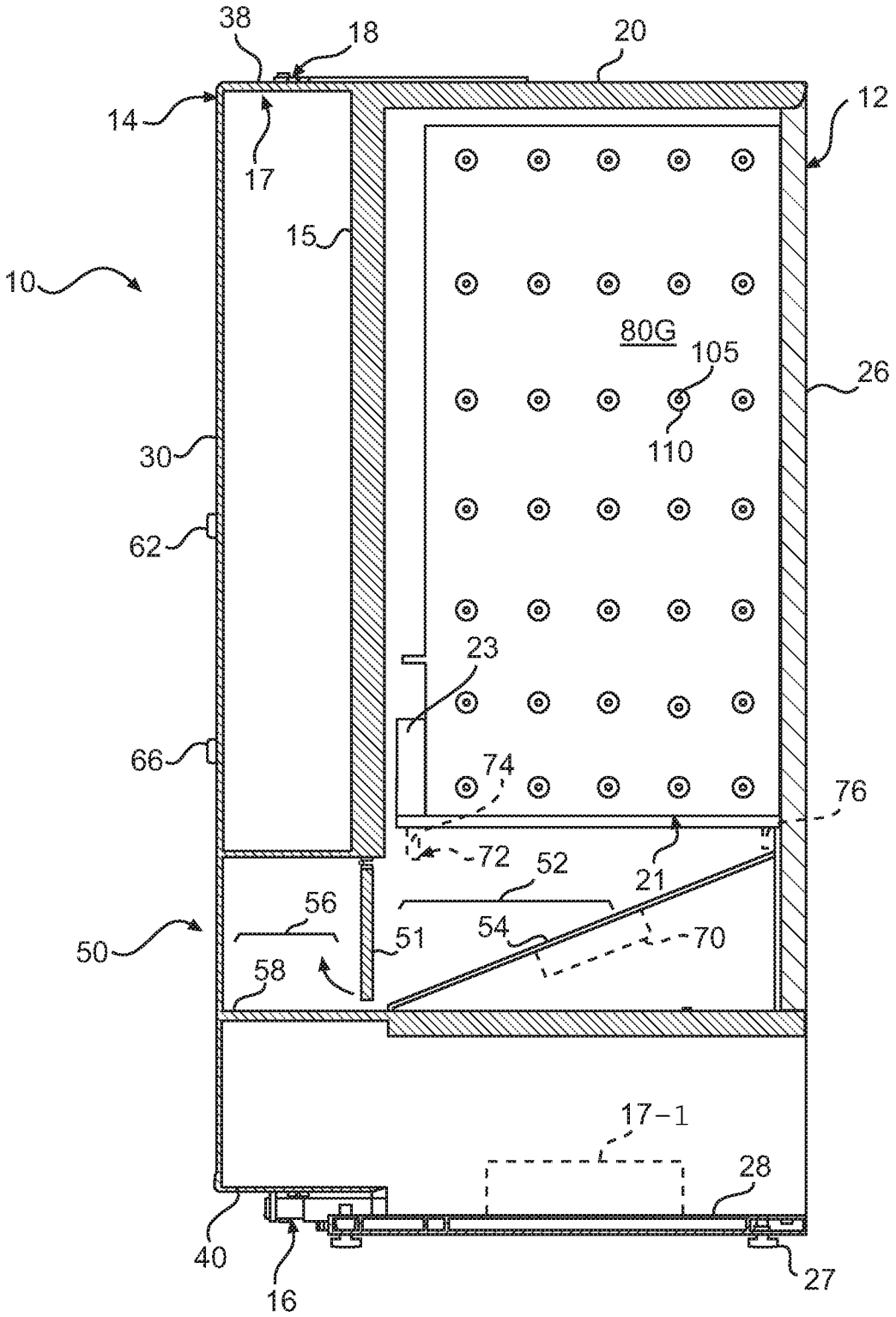
FIG. 2 is a cross sectional view taken along line 2-2 in FIG. 1.
Figure 3:
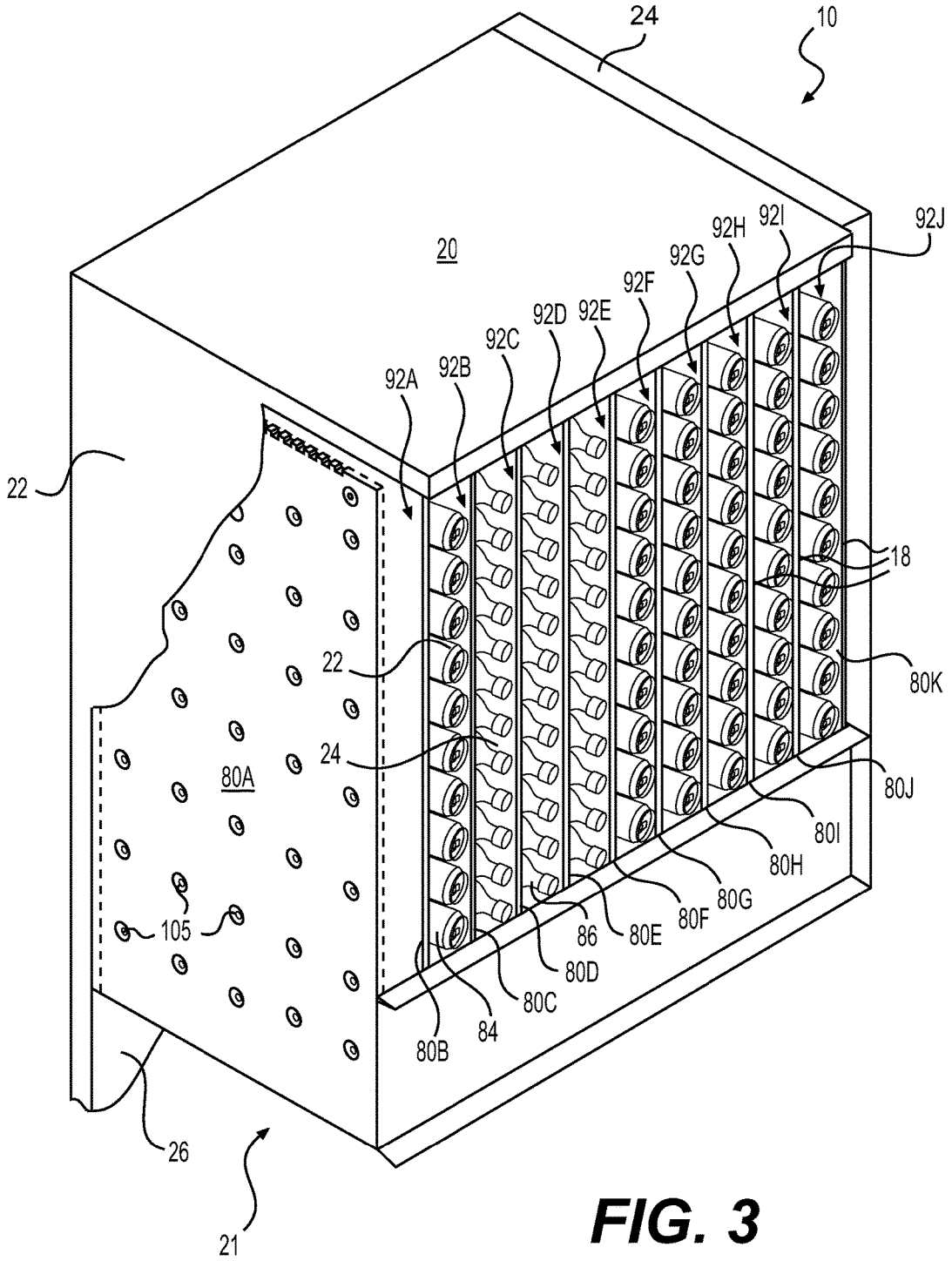
FIG. 3 is a frontal perspective showing the outside of a vending machine and the product holding area with the stacking walls and product compartments.

FIGS. 1 and 2 show such a closed front vending machine 10 as being comprised of a case or cabinet 12 that includes a front door 14 and a rear cabinet 16. Front door 14 is pivotally mounted to the rear cabinet by top and bottom hinges 18 and 19, respectively. Front door 14 includes an inner door 15 that can be pivotally attached either to an inside portion of an outer portion 17 of the front door, or to the rear cabinet 12, and in either case by hinges (not shown). The outer portion 17 is designed to overly the inner door 15 with the latter being an insulating door that will close over the front of the product holding section 21, as shown in FIG. 3, to keep the contents of a product holding section 21 cold when vending cold or frozen products. The vending equipment 10 can also include a suitable refrigeration unit 17-1, as shown in FIG. 2, to maintain desired temperatures within the product holding section 21.

With reference to FIGS. 2 and 3 the main rear cabinet is 16 that is itself comprised of separate top wall 20, opposing side walls 22 and 24, a rear wall 26 and a bottom wall 28, as well as a plurality of height adjustable feet 27. The front door 14 and the rear portion 16 collectively define the outer casing structure 12 for the vending machine 10.

The front door 14 includes a front panel 30 that is retained in a frame formed from opposing sides 34 and 36, a top 38 and a bottom or base plate 40. Door 14 also includes and supports a coin changer including a change return 42, a suitable keypad 43, a control panel 44, a display 45, and a dispensed product retrieval opening 50. Door 14 has sufficient internal space to mount other parts of the vending machine such as, for example, control electronics, the coin changer assembly, a bill validator 46, or other devices as may be desired. The front panel 30 can also include exemplary bottles 60 and bottle selection buttons 62 and exemplary cans 64 and can selection buttons 66.

The vending machine 10 includes a product holding section 21, as shown in FIG. 3, that can be comprised of a plurality of spaced apart product containment walls 80A-80K, as will be discussed hereinafter, forming between a pair of such adjacent walls product holding compartments in which product, such as, for example, cans or bottles, can be stacked vertically. The product holding section 21 can also include any form or grouping of known product dispensing assemblies 23 there below each area of stacked product as one might envision for such a vending machine 10, which can be of varying types and/or configurations, limited only by the particular products one might choose to vend from within the vending machine as a whole. The vending machine 10 will also include suitable vend motors, not shown, as part of the product dispensing assemblies as needed to dispense product from each of the plurality of columns or product holding compartments containing stacked products within the product holding section 21.

Located below the product holding section 21 is a drop zone area 52 at the bottom of which is a product directing ramp or panel 54 that is an angled sheet, for example of metal or plastic, whose angle of inclination from back to front will direct a dispensed product falling from the product holding section 21 forwardly through a swinging door 51 and toward a front product retrieval area 56 and onto floor 58 thereof from which the selected and dispensed product can be retrieved via the opening 50.

The vending machine 10 can also include a suitable vend detection or sensing system. One such system is shown in phantom at 70 is a vibration sensor attached to the bottom side of ramp or plate 54 to sense when a product has fallen onto that ramp or plate 54. A vend sensing system could also be of an infrared type as is diagrammatically shown generally at 72 in FIG. 2 and includes suitable emitter/detector units, 74/76, respectively, extending along each of the two opposing sides or ends of the space or drop zone 52, which will create a plane of infrared radiation operating across the depth and width of the drop zone 52 so that along with suitable control equipment the system will sense passage of a dispensed product falling through the field of radiation.

FIG. 3 shows a cut away view of the interior of a vending machine 10 and the product holding section 21 that is comprised of a plurality of internal stacking walls 80A-80K, as shown from left to right, that are spaced apart to form a plurality of product holding compartments 92A-92J in which product is stacked, for example in rows, prior to being vended. Compartment 92B is shown as holding stacked rows of cans 84 while compartment 92C is holding stacked rows of bottles 86.

Figure 4:
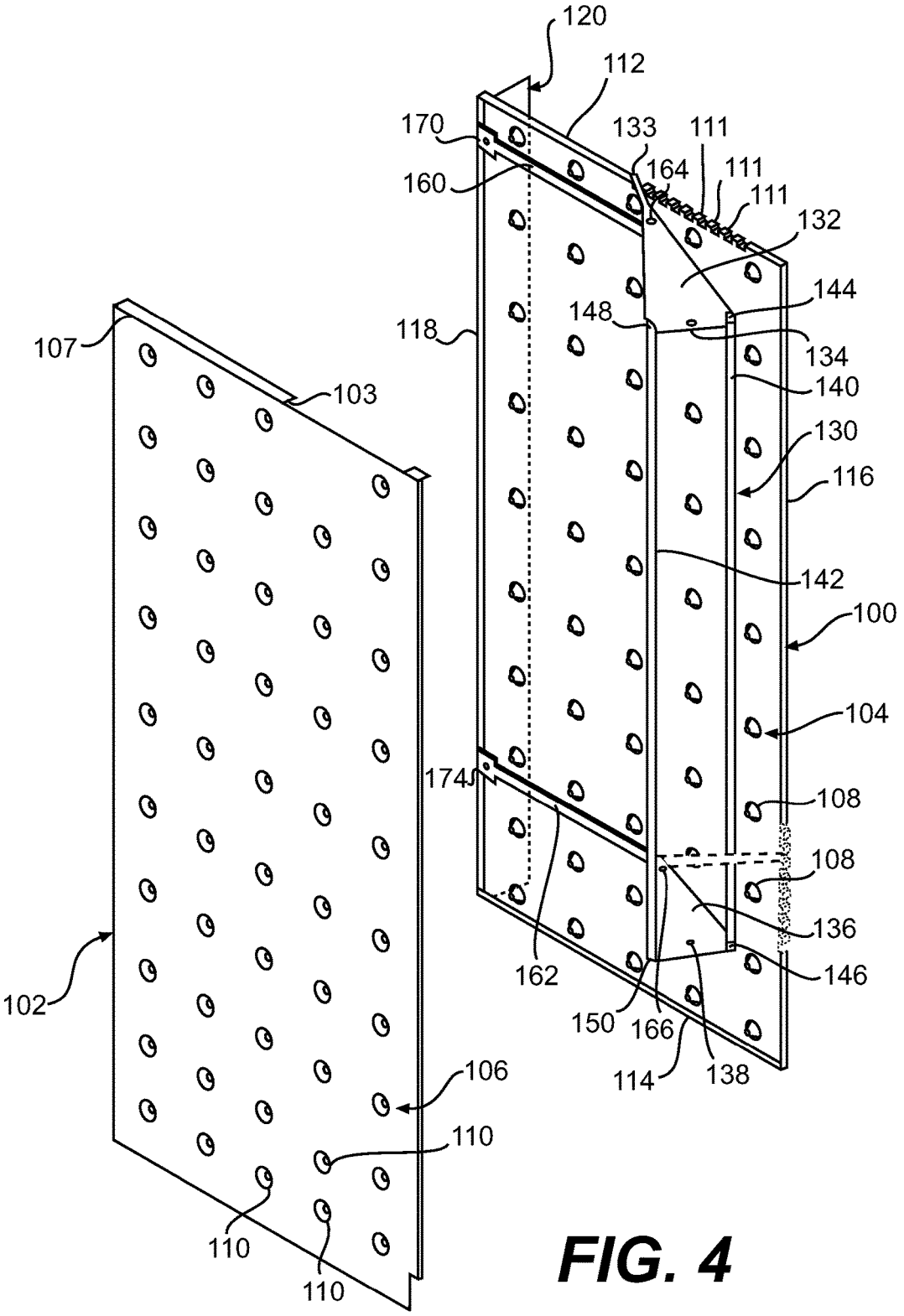
FIG. 4 is a perspective view of a stacking wall showing the adjustable depth rear retainer wall mechanism.

Each of the stacking walls 80A-80*k*, as shown in FIG. 4, is comprised of two panels and in particular right and left panels, 100 and 102, respectively. Each panel 100/102 is preferably formed from sheet metal, but they could also be cast, molded or otherwise formed. Each panel 100/102 can be provided with a plurality of inwardly directed dimples 110 that are positioned so that when the panels 100/102 are connected and secured together, for example by rivets 105 shown in FIG. 3, the inside surfaces 108 of each of the dimples 110, as shown in FIG. 4, on one panel 100 will contact and mate against the corresponding inside surface of the opposing recesses or dimples on the opposing panel 102 thereby forming a hollow interior. The dimples or recesses 110 are preferably stamped into each panel by passing each panel 100/102 through a sheet forming press or apparatus in which suitable dies will create rows of the dimples or recesses 110. Such sheet forming apparatus can feed panels either sequentially, so that row after row can be formed, or fed so that more than one row could be formed during each stamping cycle, for example all pairs of rows or for that matter all of the rows on a single panel depending upon the precise sheet forming press or apparatus being used. Since such stamping will employ known techniques no further explanation is believed to be warranted.

Panels 100/102 are preferably mated using rivets 105 that are placed in the center of the dimples with the combined height each dimple 110 forming a distance between panels 100/102 that is preferably about 0.344 inches, although other thickness dimensions could vary form about 0.040 inches to about 0.750 inches. Each panel 100/102 can be preferably formed from 0.028 inch thick sheet metal, but the sheet metal could be as thin as 0.015 inches, and they could be formed from thicker material that the preferred 0.028 inch thickness, for example 0.100 inches.

It should be understood that a variety of edge forming arrangements can be employed such as two short flanges that meet along a flange edge or curved or rounded flanges might be used that could then inter fit, or the flanges might be formed with a plurality of spaced apart flanges or flange segments, while the mating panel would have a similar structure but with its spaced apart flanges or segments formed so that its sets of flanges could interfit with or into the adjacent gaps or spaces in the first panel. It should also be understood that mating edges could be welded, spot welded, glued or to the extent there is a seam between the panels that seam could smoothed or rounded. Alternatively the mating edges could be left alone that would still form an outer edge of the stacking walls 80A-80K when the panels, for example '100 and 102, are mated together.

By forming the stacking walls in this manner they have sufficient strength to fully support products stacked in the compartments 92A-92J as shown in FIG. 3 without any further bracing and without bowing under the forces from products stacked within a particular compartment 92A-92J. Stacking walls 80A-80K preferably can be about 21 inches wide and about 46 inches high, but the precise size will depend upon the particular vending machine and product holding area. However, it is believed that size will fit within most standard sized vending machines. Where a vending machine is larger or smaller that an industry standard size the internal stacking walls 80A-80K can be appropriately sized for that particular vending machine size.

As shown in FIG. 4, each stacking or retaining wall 80A/80K can include within its hollow interior an adjustable mechanism, generally indicated at 130, that can be secured in place within that hollow interior yet will be operable by a vend operator from the front of the product holding area 21 when door 14 is open to easily and quickly vary the depth of a product holding compartment between two adjacent stacking walls.

Each of the stacking or retaining walls 80A/80K can be fabricated from two panels as shown, for example in FIG. 4, by panels 100 and 102. The walls 80A/80K can be made as is described in co-pending patent application Ser. No. 14/684,904, and that application is incorporated herein by reference thereto. Each panel can be comprised of sheet metal that can vary in thickness of 0.015-0.100 inches, although the panels could be fabricated form other materials including plastics, reinforced plastics, polycarbonate or other man made materials. Panel 100 can have a plurality of rows 104 of dimples or recesses 108, while the opposite panel 102 can have a like plurality of rows 106 of dimples 110 so that when panels 100/102 are connected together, with an inside surface of each dimple 108 in panel 100 coming into contact with a corresponding inside surface of each dimple 110, and the panels can be secured together by rivets, for example as shown at 105 in FIG. 3, inserted and fastened through the center of each of the mating dimples, or by spot welding at the center of each dimple, or by another securing technique that will rigidly connect the panels together. Panel 100 also has a top edge 112, a bottom edge 114, and front and rear edges 116 and 118, respectively.

With reference to FIGS. 4-7 each panel includes an adjustable rear wall 120, and an adjusting mechanism 130. The adjusting mechanism includes an upper control member 132 pivotally attached to panel 100 at a pivot joint 134, and a lower control member 136 that is pivotally attached to panel 100 at a pivot joint 138. Two control links 140 and 142. Link 140 is pivotally connected at pivot joints 144 and 146 to the upper and lower control members 132/136, respectively. Link 142 is also connected to the upper and lower control members 132/136 at pivot joints 148 and 150.

There are also upper and lower power links 160 and 162, with the upper power link 160 pivotally connected to the upper control member 132 at a pivot joint 164, while the lower power link 162 is pivotally connected to the lower control member 136 at a pivot joint 166. The opposite end of power link 160 is pivotally connected at a pivot joint 168 to a spring clip 170, that can either be integrally formed with the power link 160 or provided as a separate added member, that has a width that is wider than a slot 180 provided in the rear portion of panel 100 that is spaced about 3 inches below the top edge 112. A lower slot 182 is provided in the rear portion of panel 100 and is located about 8 inches above bottom edge 114. The lower power link 162 has its opposite end pivotally connected at a pivot joint 172 to another spring clip 174, that again can either be integrally formed with the power link 160 or provided as a separate added member, and which is wider than lower slot 182.

Figure 5A:
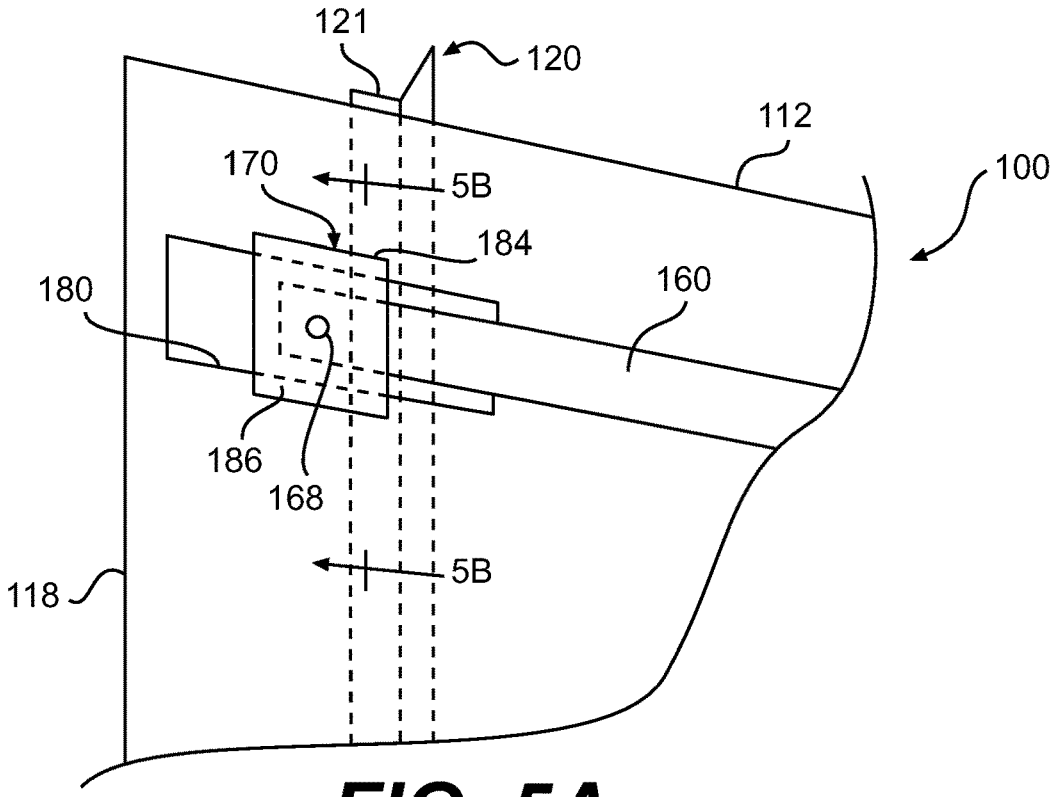
FIG. 5A shows a partial, cutaway perspective view of a spring clip portion of the adjusting mechanism.
Figure 5B:
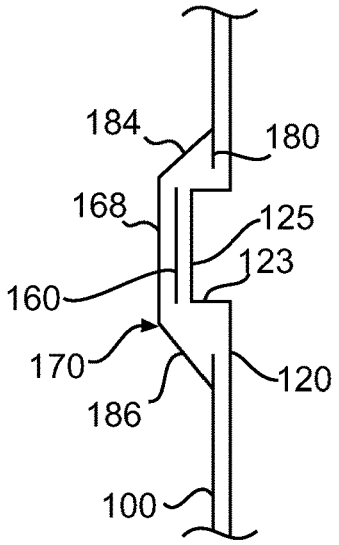
FIG. 5B shows a cross sectional view taken along line 5B-5B in FIG. 5A.

As shown in FIGS. 5A and 5B for spring clip 170, which will be the same for the other of the two spring clips 174, the upper power link 160, which as noted is pivotally connected by rivet 168 to the center of the spring clip 170, will extend behind the spring clip 170 a short distance as shown in phantom. Each spring clip 170/174 will include two bent edge portions, 184 and 186 that will rest on a surface of panel 100 on opposite sides of the slot 180*m* as in FIGS. 5A/5B. Since the power link 160 will move relative to the surface of panel 100 the bent edge portions 184/186 will provide a spring or compression effect between the spring clips themselves, 170/174, and the adjustable rear wall 120. The spring clips 170/174, and in particular rivet 168, will also connect to the adjustable rear wall 120 through a cut and bent portion of a side 121 thereof that includes a right angle bend 123 and a tab 125, with both the bent portion 123 and the tab 125 having a height dimension that is less than the vertical height or width of slot 180. Thus, as power link moves back and forth it will move spring clips 170/174 forward and backward and, consequently move and thereby adjust the position of rear wall 120, and thereby the depth of that product holding compartment, as the tab 125 that is part of the side wall of wall 120 slides within slots 180/182.

Figure 6:
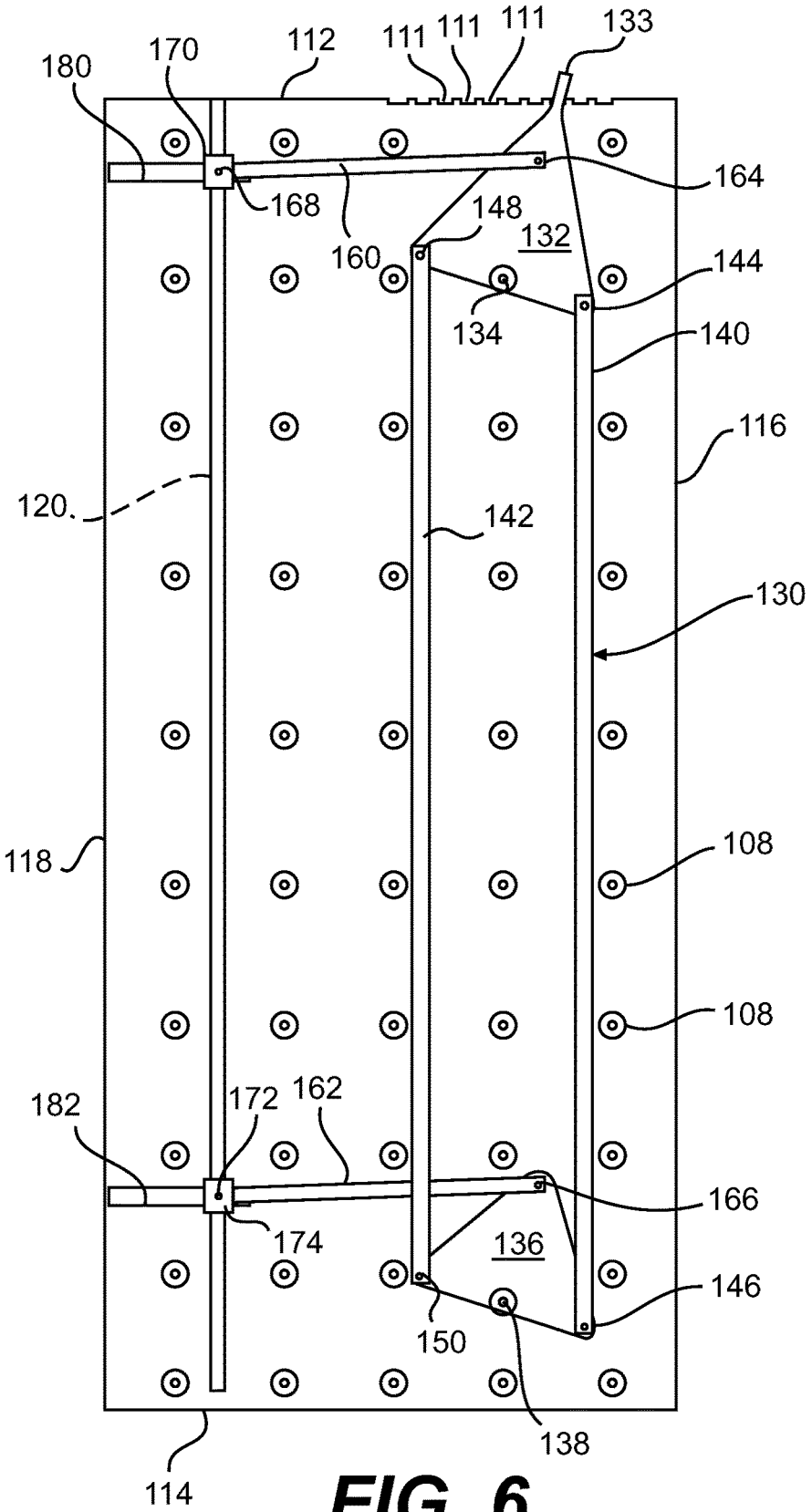
FIG. 6 shows a front elevational view of the adjustable mechanism for the depth adjustable rear retaining wall in a partially forward position.
Figure 7:
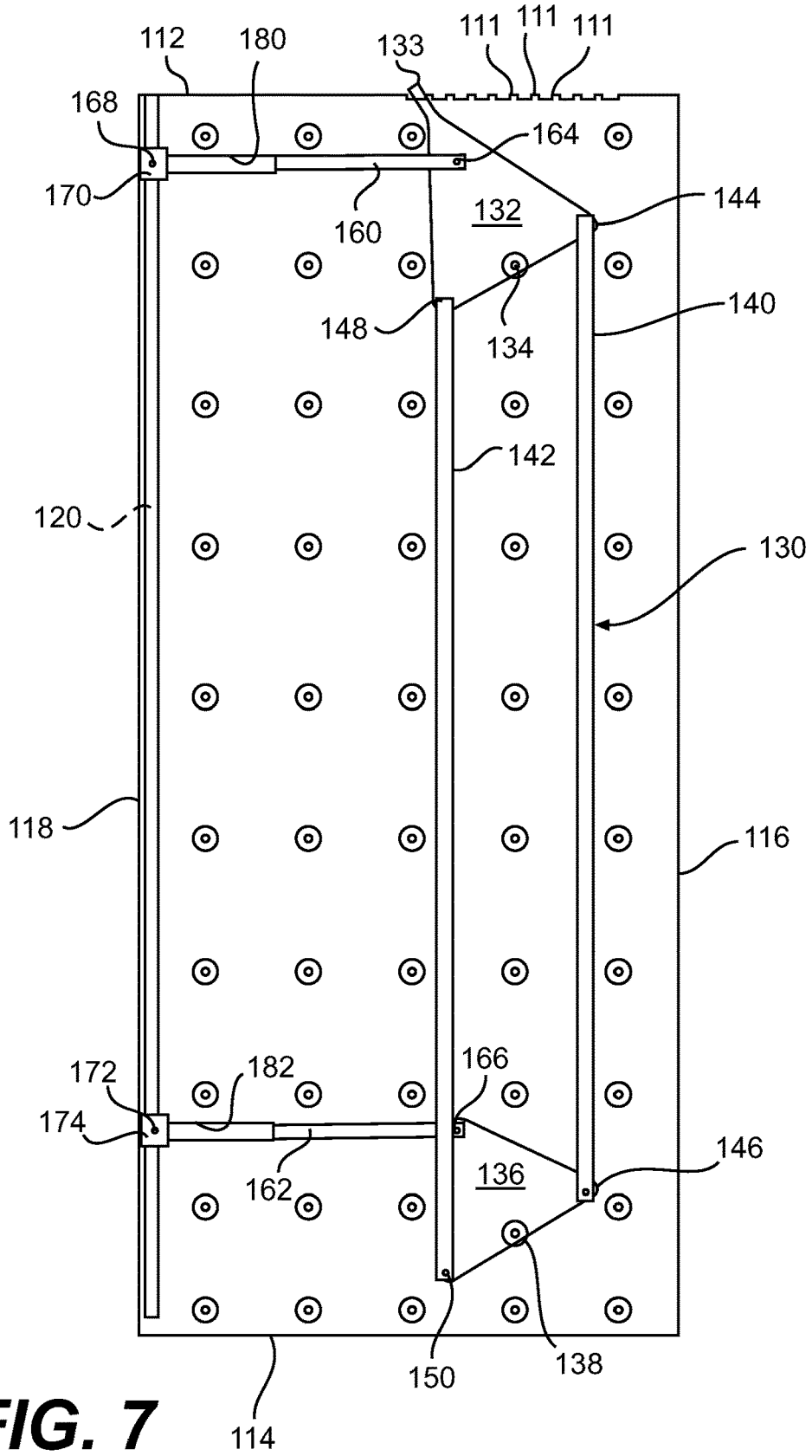
FIG. 7 shows a front elevation of the stacking wall panel in FIG. 5 with the depth adjustable rear retaining wall in a full rearward position.

As shown in FIGS. 4 and 6, the upper control member 132 includes an upwardly extending handle 133 that will extend upwardly through an opening 103, for example provided in a right angle flange 107 provided as the top of panel 102. The top edge 112 of panel 100 will be provided with a series or plurality of spaced apart teeth 111 each of which will be in the form of a short right angle flange as shown in FIG. 4 that extend toward the inside surface of panel 100 and toward the interior of wall 80A/80K. Handle 133 will be bent slightly in order to bias the handle toward the exterior of panel 100. When panels 100 and 102 are connected together in a rigid wall 80A, for example, handle 133 will extend outwardly beyond the top edge of wall 80A so that an individual can grip and move handle 133 inwardly, against a bias tending to push handle 133 toward the teeth. With the handle 133 clear of teeth 111 the handle 133 can be moved either forwardly or rearwardly thereby also moving the control member 132 and the linkages attached thereto to move the rear wall 120 to a desired location at a depth selected for the products to be stacked. Handle 133 is sized to fit between any two of the plurality of teeth 111 and when at a desired location handle can be held in between two of the teeth 111 due to the slight bend and outward bias of handle 133.

It should be appreciated that handle 133 could also be located in a different location. For example, handle 133 could be formed as a part of the lower control member 136 and extend outwardly beyond the front edge 116 on which suitable teeth, like those shown at 111, could also be provided to act as incremental stops for the handle 133 as the adjustable rear wall 120 is moved to one of a plurality of stop locations or be moved incrementally to change and control the depth of the compartment holding bottles or cans.

As the upper control member 132 is rotated each of the two control links 140/142 will be moved through their respective pivot connections 144/146 and 148/150 that will cause the lower control member 136 to also rotate about its pivot connection 138. As each of the upper and lower control members 132/136 rotate each will move its power link, 160 and 162 that will in turn move the upper and lower portions of the adjustable rear wall 120 causing wall 120 to slide along the exterior of wall 80A, for example, and be movable to define a desired compartment depth, for example in the compartment between stacking walls 80A and 80B, and then simply locked in place via handle 133 and teeth 111. Since handle 133 and the opening 103 will be located at the forward portion of each of the stacking or retaining walls 80A/80K the position of the rear compartment wall 120 for any of the compartments defined between any two adjacent stacking walls can be easily adjusted from the front of each stacking wall 80A/80K as used in the product holding portion 21 when door 14 is open. It should be understood, with reference to FIG. 3, that the far right stacking wall 80K will not need to have an adjustable wall 120 attached to it as there is no compartment on its right side, and can be a simple double wall structure, as previously noted above, without the present adjustment mechanism as is described herein.

E. Options and Alternatives

Figure 8:
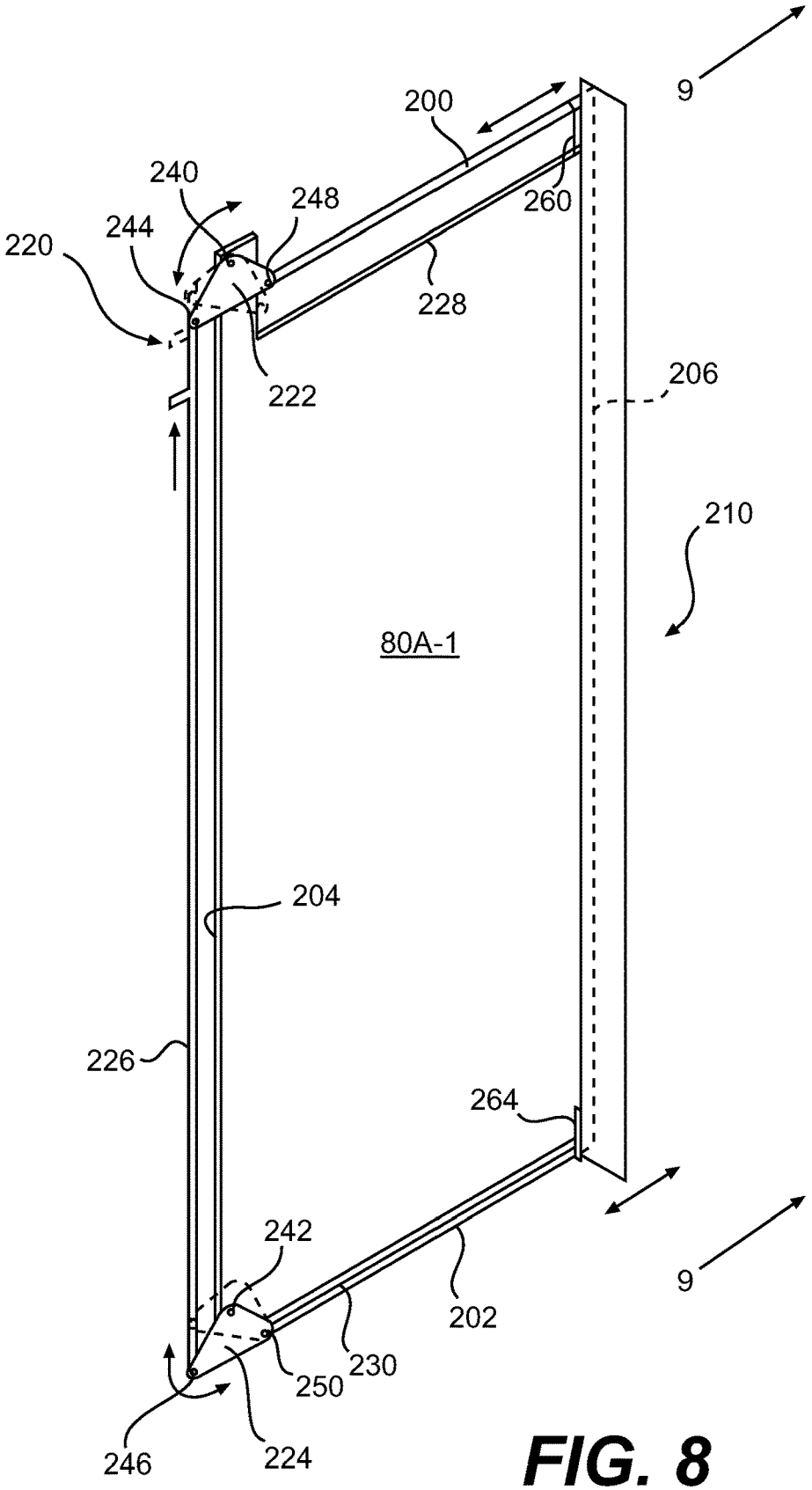
FIG. 8 shows an additional embodiment of the present invention.
Figure 9:
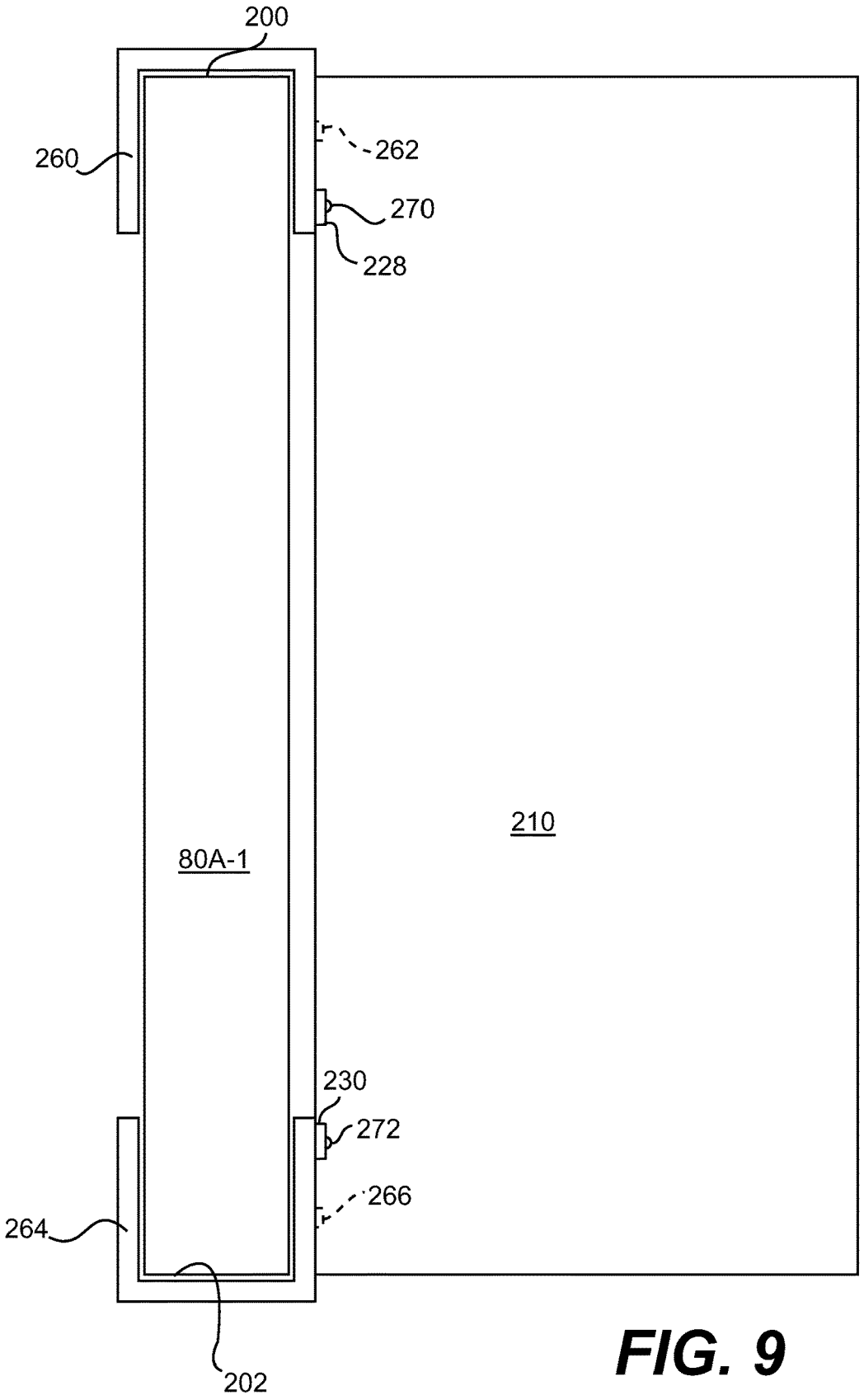
FIG. 9 shows an enlarged cross sectional view along line 9-9 of a portion of FIG. 8 showing the top and bottom of the rear wall sliding connection.

An alternative embodiment is shown in FIGS. 8 and 9 where a stacking wall 80A-1 has top, bottom, front and rear edges 200, 202, 204 and 206, respectively. An adjustable rear compartment wall 210 is under the control of an adjustment mechanism 220 comprised of an upper control member 222, a lower control member 224, a vertically extending and inter-connecting control link 226, and upper and lower power links 228 and 230.

The upper control member 222 is pivotally attached to wall 80A-1 at a pivot joint 240 and the lower control member 224 is attached a t a pivot joint 242. The control link 226 is attached by a pivot joint 244 to the upper control member and at a pivot joint 246 to the lower control member 224. The upper power link 228 is connected to the upper control member at a pivot joint 248 and pivot joint 250 provides the connection between the lower power link 230 and the lower control member 224.

As shown in both FIGS. 8 and 9 the rear compartment wall 210 is connected to an upper U-shaped slider 260 by rivets 262 and to a lower U-shaped slider 264 by rivets 266. The upper power link 228 is pivotally connected to the upper slider by a pivot joint 270 and the lower power link 230 is connected to slider 264 by a pivot joint 272. The two U-shaped sliders 260 and 264 will fit over the top and bottom edges of wall 80A-1, for example, and as they are moved by the upper and lower power links, 228 and 230, the rear compartment wall 210 will traverse forwards and backwards along that wall 80A-1.

It should also be understood that the stacking walls 80A-80K could also be formed, for example, from a stiffened single sheet structure with the adjustable mechanism being then connected, for example, as shown herein to that single sheet, but not within a hollow interior of a double walled stacking wall structure.

While the panels are preferably formed from sheet metal, they can also be made from a variety of materials including plastics, polycarbonate, reinforced plastics, or they could be formed as a solid structure in which internal voids could be formed as desired.

When introducing elements of various aspects of the present invention or embodiments thereof, the articles "a," "an," "the" and "said" are intended to mean that there are one or more of the elements, unless stated otherwise. The terms "comprising," "including" and "having," and their derivatives, are intended to be open-ended terms that specify the presence of the stated features, elements, components, groups, and/or steps, but do not exclude the presence of other unstated features, elements, components, groups, and/or steps and mean that there may be additional features, elements, components, groups, and/or steps other than those listed. Moreover, the use of "top" and "bottom," "front" and "rear," "above," and "below" and variations thereof and other terms of orientation are made for convenience, but does not require any particular orientation of the components. The terms of degree such as "substantially," "about" and "approximate," and any derivatives, as used herein mean a reasonable amount of deviation of the modified term such that the end result is not significantly changed. For example, these terms can be construed as including a deviation of at least +/−5% of the modified term if this deviation would not negate the meaning of the word it modifies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A vending machine having a plurality of interior product holding compartments, each of the plurality of interior product holding compartments having a front to rear depth, a width and a height dimension and defined between a pair of adjacent, spaced apart front to rear extending stacking walls, each stacking wall comprising a pair of facing substantially flat panels each having top, bottom and side edges, and wherein at least one of the pair of substantially flat panels includes a plurality of fasteners operatively connecting the pair of facing panels together at least at selected locations forming a double wall structure with a hollow interior, a wall member movably mounted to one of the pair of stacking walls defining one of the plurality of interior product holding compartments, said wall member being mounted so as to extend vertically there along and outwardly from said one of the pair of stacking walls, the wall member comprising a depth adjustable rear wall in the one of the plurality of interior product holding compartments that will fit across a selected portion of the height dimension and width thereof, and a wall member adjustment mechanism for moving the wall member between rearward and forward positions within front to rear depth of desired one of the plurality of interior product holding compartments, said wall member adjustment mechanism being mounted within the hollow interior of said one of the pair of stacking walls and at both an upper and a lower portion of said wall member so that both upper and lower portions move in unison as the wall member is adjusted between rearward and forward positions with the adjustment mechanism being controlled from a location at a front portion of said one of the pair of stacking walls.

2. The vending machine as in claim 1 wherein the wall member adjustment mechanism comprises a first member pivotally connected to one of the flat panels, a second member pivotally connected to said one flat panel on which the first member is connected at a second location spaced from the location of the first member, a first link member interconnecting the first and second members at respective first link positions on each of the first and second members, a first drive link interconnecting the first member and the wall member at a first position, a second drive link interconnecting the second member and the wall member at a second position spaced from the first position, and an operating handle connected to one of the first or second members that is accessible from a front part of the stacking wall.

3. The vending machine as in claim 2 wherein the operating handle is connected to the first member and extends outwardly beyond a front portion of an upper edge of the stacking wall.

4. The vending machine as in claim 2 wherein the handle is positioned adjacent a front of the interior product holding compartments.

5. The vending machine as in claim 2 further including a second link member that extends parallel to the first link member and interconnects the first and second members at second link locations, respectively, spaced from the first link positions.

6. The vending machine as in claim 2 wherein the first link member is pivotally attached to each of the first and second members.

7. A stacking wall for a vending machine and forming at least one side of a product holding compartment from which a selected product can be dispensed, the stacking wall having top, bottom, front and rear edges defining height and front to rear depth dimensions thereof, said stacking wall further comprising a pair of facing substantially flat panels each having top, bottom and side edges, and wherein the stacking wall has a plurality of fasteners operatively connecting the pair of facing panels together at least at selected locations forming a front to rear extending double wall structure with a hollow interior, a vertically extending wall member movably mounted to one side of said stacking wall facing the product holding compartment, the vertically extending wall member having a height dimension and a width to fit across a selected portion of a height dimension and width of the product holding compartment, and an adjustment mechanism operatively mounted within the hollow interior of said stacking wall and to the vertically extending wall member so as to incrementally move both lower and upper portions of said wall member simultaneously between back and forward positions along said one side of the stacking wall so as to variably adjust a stacking depth of the product holding compartment; wherein the adjustment mechanism has a control member extending outwardly from the hollow interior of said stacking wall at a location adjacent a front portion thereof for operating the adjustment mechanism and moving the wall member forwardly and rearwardly within the product holding compartment.

8. The stacking wall as in claim 7 wherein the control member extends outwardly from said top edge.

9. The stacking wall as in claim 7 wherein the control member is located at the front edge of said stacking wall.

10. A vending machine comprising:

a plurality of interior product holding compartments, each product holding compartment having a depth, a width and a height dimension, a plurality of adjacent, spaced apart stacking walls, each of the plurality of interior product holding compartments defined between a pair of the plurality of stacking walls, a wall member movably mounted to one of said pair of stacking walls so as to extend vertically there along and outwardly therefrom, the wall member comprising a depth adjustable rear wall in one of the product holding compartments that fits across a selected portion of the height dimension and width thereof, and each of the plurality of stacking walls comprising a pair of facing substantially flat panels, each of the flat panels having top, bottom and side edges and at least one of the pair of facing panels having a plurality of separators positioned thereon at spaced apart locations, and a plurality of fasteners operatively connecting the pair of facing panels together thereby forming a double wall structure having a hollow interior, and a wall member adjustment mechanism mounted within said hollow interior for moving the wall member between rearward and forward positions within the depth of said one said plurality of product holding compartments, wherein the wall member adjustment mechanism comprises a first member pivotally connected to one of the flat panels at a first location, a second member pivotally connected to said one of the flat panels at a second location spaced from the first location, a first link member interconnecting the first and second members, a first drive link interconnecting the first member and the wall member at a first position, a second drive link interconnecting the second member and the wall member at a second position spaced from the first position, and an operating handle operatively connected to one of the first and second members and being accessible from a front portion of said one of said pair of stacking walls.

11. A vending machine having a plurality of interior product holding compartments, each product holding compartment having a depth, a width and a height dimension and defined between a plurality of adjacent spaced apart stacking walls, each one of the plurality of adjacent spaced apart stacking walls having top, bottom and side edges, each of the stacking walls comprising a pair of facing substantially flat panels and a plurality of fasteners operatively connecting the pair of facing panels together at least at selected locations forming a double wall structure with a hollow interior, and a depth adjustable rear wall movably mounted on one side of one of the plurality of adjacent spaced apart stacking walls so as to extend vertically there along and outwardly therefrom so as to fit across a selected portion of the height dimension and the width of one of the plurality of product holding compartments, and a depth adjustable rear wall adjustment mechanism mounted within the hollow interior for moving the depth adjustable rear wall between rearward and forward positions so as to adjust the depth of said one of the plurality of product holding compartments, the depth adjustable rear wall adjustment mechanism comprising a first member pivotally connected to one of the pair of facing substantially flat panels at an upper location, a second member pivotally connected to said one of the pair of facing substantially flat panels at a second location spaced from and below the upper location of the first member, a first link member interconnecting the first and second members, a first drive link interconnecting the first member and an upper portion of the depth adjustable rear wall at a first position, a second drive link interconnecting the second member and a lower portion of the depth adjustable rear wall at a second position spaced from the first position, and an operating handle connected to one of the first and second members and extending outwardly from said one of said plurality of adjacent spaced apart stacking walls so as to be operated from a front portion of said one of said plurality of adjacent spaced apart stacking walls and so that both the upper and lower portions of the depth adjustable rear wall move in unison as the depth adjustable rear wall is adjusted between the rearward and forward positions.

* * * * *